US008523472B2

(12) United States Patent
Jimenez

(10) Patent No.: US 8,523,472 B2
(45) Date of Patent: Sep. 3, 2013

(54) DENTIFRICE CONTAINER WITH ORAL CARE IMPLEMENT HOLDER

(75) Inventor: Eduardo Jimenez, Manalapan, NJ (US)

(73) Assignee: Colgate-Palmolive Company, New York, NY (US)

( * ) Notice: Subject to any disclaimer, the term of this patent is extended or adjusted under 35 U.S.C. 154(b) by 1277 days.

(21) Appl. No.: 11/849,613

(22) Filed: Sep. 4, 2007

(65) Prior Publication Data

US 2009/0060623 A1 Mar. 5, 2009

(51) Int. Cl.
*A46B 11/00* (2006.01)

(52) U.S. Cl.
USPC ..... 401/123; 132/311

(58) Field of Classification Search
USPC ..... 401/123–125; 15/184, 185; 132/311
See application file for complete search history.

(56) References Cited

U.S. PATENT DOCUMENTS

| | | | | |
|---|---|---|---|---|
| 2,100,960 | A | | 11/1937 | Jacoby |
| 2,167,761 | A | * | 8/1939 | Levin Bessie M et al. ... 401/291 |
| 2,883,692 | A | * | 4/1959 | Kaye et al. ..... 15/184 |
| 3,155,279 | A | | 11/1964 | Ferguson |
| 3,734,118 | A | | 5/1973 | Howard |
| 4,600,126 | A | | 7/1986 | Arango |
| 4,705,194 | A | | 11/1987 | Judge |
| 5,271,529 | A | | 12/1993 | Stuber |
| 5,388,599 | A | * | 2/1995 | Yen ..... 132/311 |
| 5,415,187 | A | | 5/1995 | Heneveld |
| 5,735,298 | A | | 4/1998 | Mayne et al. |
| 5,871,124 | A | | 2/1999 | Wilkinson |
| D417,082 | S | | 11/1999 | Classen et al. |
| 6,022,162 | A | | 2/2000 | Aumuller |
| 6,547,104 | B1 | | 4/2003 | Wilkinson |
| 6,789,703 | B2 | | 9/2004 | Pierre-Louis |

FOREIGN PATENT DOCUMENTS

| | | | |
|---|---|---|---|
| EP | 0 163 189 | A | 12/1985 |
| WO | 9704685 | A | 2/1997 |
| WO | 2005011436 | A | 2/2005 |
| WO | 2005122828 | A | 12/2005 |
| WO | WO2006/059193 | A1 | 6/2006 |

OTHER PUBLICATIONS

International Search Report Dated Oct. 24, 2008.

* cited by examiner

*Primary Examiner* — Davis Hwu
(74) *Attorney, Agent, or Firm* — Judy W. Chung

(57) ABSTRACT

A portable oral care system comprises an oral care implement and a dentifrice container. The portable oral care system has an oral care implement with a handle and a head with a tooth cleaning element. The oral care implement is collapsible to be configurable between a use and a transport state. Further, the oral care system has a dentifrice container with a cavity for holding dentifrice and a dispensing outlet. Further, when the oral care implement is in the transport state, it is engagable with the dentifrice container for securing the oral care implement to the dentifrice container.

8 Claims, 7 Drawing Sheets

DENTIFRICE CONTAINER WITH ORAL CARE IMPLEMENT HOLDER

FIELD OF THE INVENTION

The present invention relates to an oral care system, in particular, to a container with an oral care implement holder.

BACKGROUND OF THE INVENTION

While it is important to clean one's teeth regularly throughout the day, doing so can be difficult. The difficulty may result from the fact that a person usually does not have an oral care implement, such as a toothbrush, and a dentifrice, such as toothpaste, available to them throughout the course of a day. For example, at work, at a restaurant, during travel, such items might not be readily available. Further, having to carry separate items such as a toothbrush, a separate dispenser for dentifrice, etc. can be cumbersome. Additionally, carrying the toothbrush into a foreign environment has the potential to expose the toothbrush to unsanitary conditions. Generally, the toothbrush can be exposed to germs or other pathogens. Additionally, the toothbrush can be exposed to other unwanted substances. For example, during transport in a travel bag, an exposed toothbrush has the potential to come into contact with lotions, shampoo, hair, etc. The toothbrush should be kept sanitary to avoid potential health complications which may arise if an unsanitary toothbrush is used. One way of keeping the toothbrush sanitary, is to enclose the toothbrush in a separate container. However, such an additional container would further add to the number of items a user must carry.

BRIEF SUMMARY OF THE INVENTION

This invention pertains to an oral care system with an oral care implement and a dentifrice container.

In one aspect, a oral care system that may include an oral care implement and a dentifrice container which are engagable so as to form a compact, convenient, portable oral care system which maintains the oral care instrument in a sanitary condition.

In one aspect of the invention, an oral care implement has a handle and a head with a tooth cleaning element. The oral care implement is collapsible to be configurable between a "use" and a "transport" state. Further, the oral care system has a dentifrice container with a cavity for holding dentifrice and a dispensing outlet. Further, when the oral care implement is in the "transport" state, it is engagable with the dentifrice container for securing the oral care implement to the dentifrice container.

Another aspect of this invention is directed to a dentifrice container engaged with an oral care implement to form an assembly unit. The dentifrice container has a top portion and a bottom portion which engage with opposite longitudinal ends of the oral care implement to hold the oral care implement between said top and bottom portions of the dentifrice container.

Yet another aspect of this invention is directed to a dentifrice container with a cavity for holding dentifrice, a dispensing outlet and opposing first and second sidewalls. Further, the container has a top portion which extends laterally beyond the first sidewall and a bottom portion which extends laterally beyond said first sidewall. The top portion is superimposed above the bottom portion and also the top portion, bottom portion and sidewall together form a storage channel.

Other features and advantages of the invention will become apparent from the following description taken in conjunction with the following drawings.

DETAILED DESCRIPTION OF THE INVENTION

In the following description, the invention is discussed in terms of a toothbrush, but could be in the form of other oral care implements including simply a tissue cleansing implement. Further, it is understood that other embodiments may be utilized and structural and functional modifications may be made without departing from the scope of the present invention.

Figure 1:
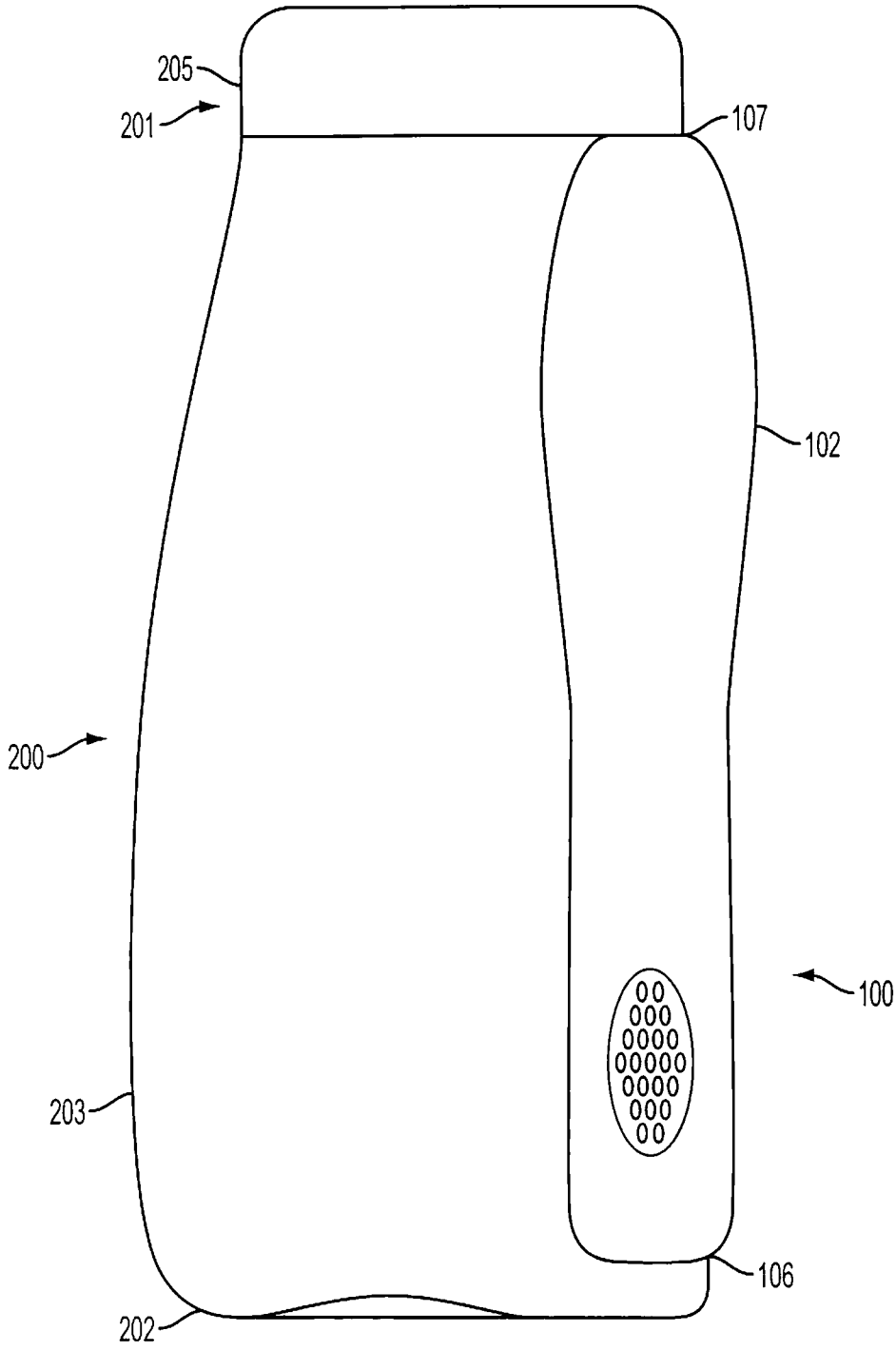
FIG. 1 is a front view of an oral care system according to one or more aspects of an illustrative embodiment wherein portions of the oral care system are engaged and the oral care implement is in a transport state.
Figure 2A:
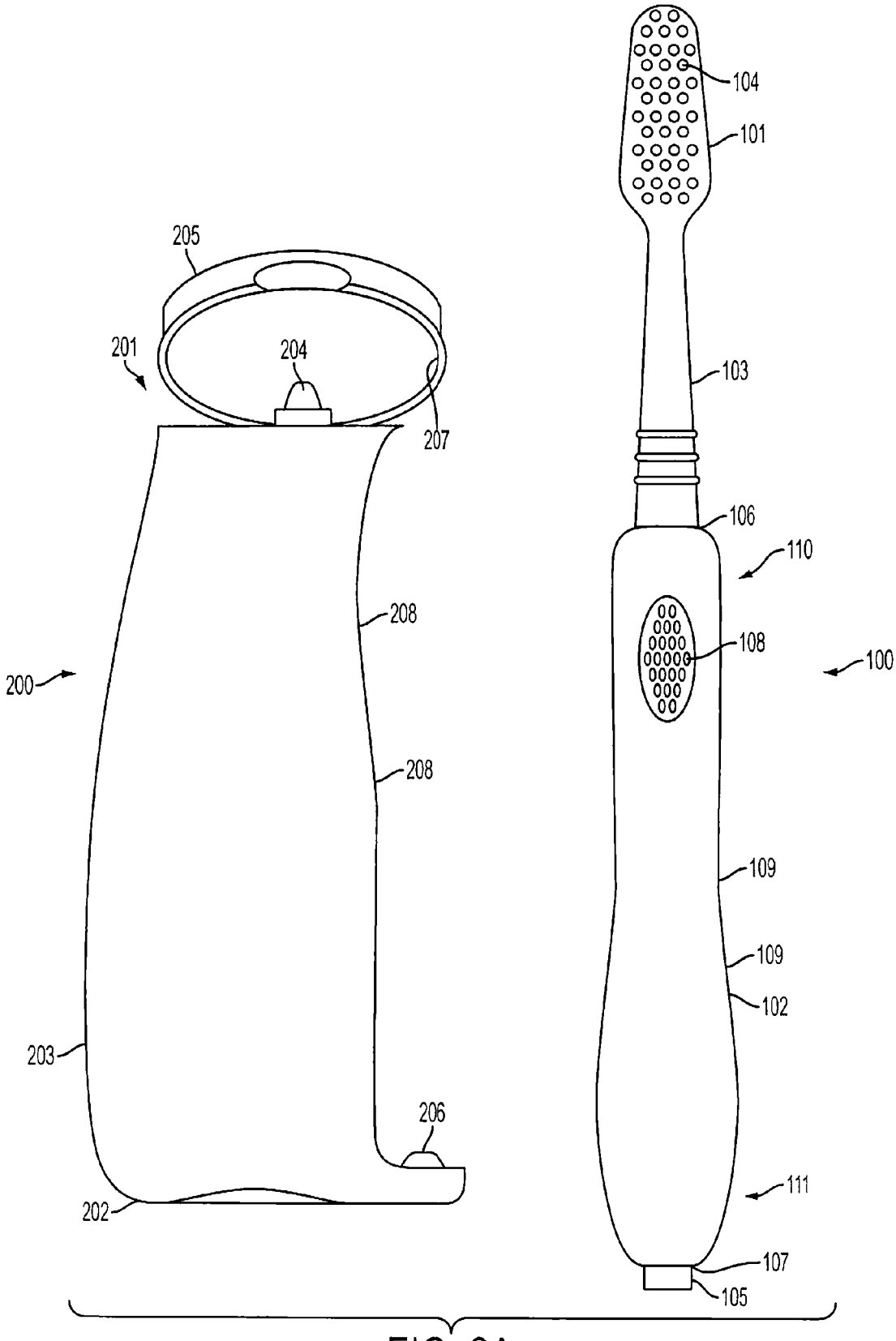
FIG. 2A is a front view of the oral care system of FIG. 1, wherein portions of the oral care system are disengaged and the oral care implement is in a use state.
Figure 2B:
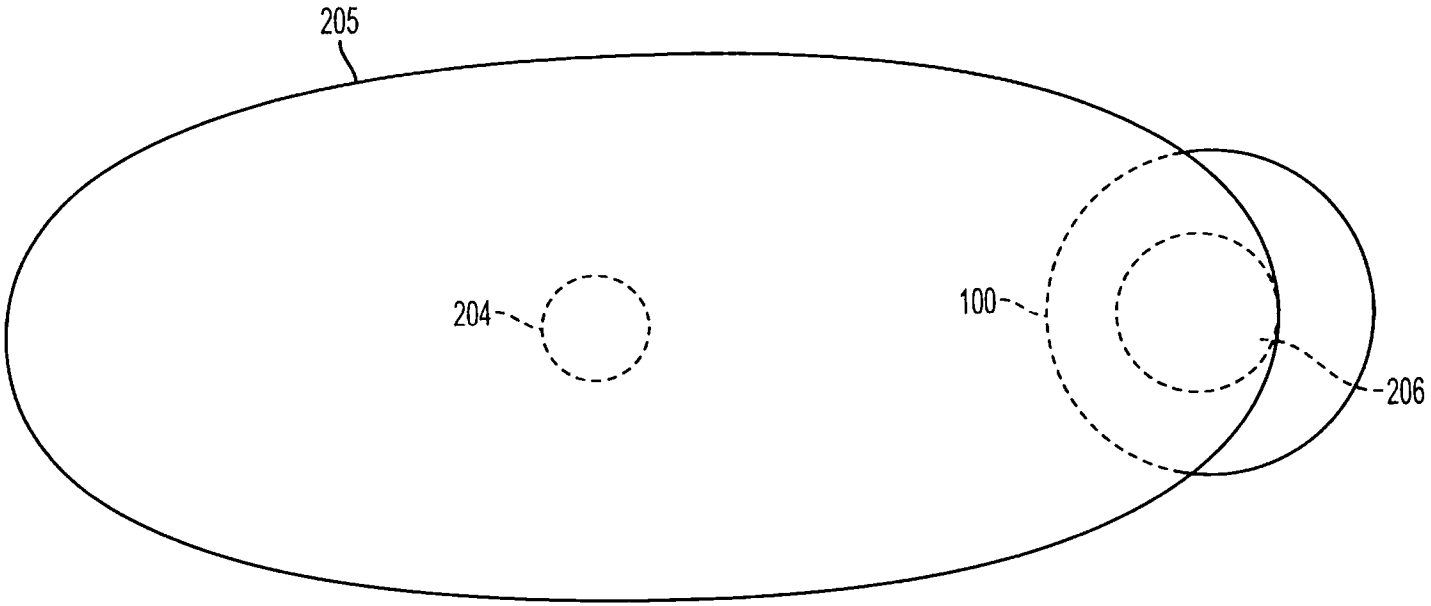
FIG. 2B is a schematic top view of an oral care system of FIG. 1.

FIGS. 1, 2A and 2B illustrate an oral care system of the present invention. The oral care system includes an oral care implement, such as a toothbrush, 100 and a dentifrice container 200. The toothbrush 100 generally includes a head 101, a handle 102 and a neck portion 103 for connecting the head 101 and the handle 102.

The handle 102 is generally an elongated member that is dimensioned for the user to readily grip and manipulate the toothbrush 100. The handle 102 may be formed of any desired shape or length and in any desired configuration or construction. In the illustrative embodiments shown in FIGS. 1-4, the handle 102 has a sidewall that is shaped to be complementary to and to mate with an applicable sidewall of the dentifrice container 200 as described below. In the depicted embodiment the handle 102 has a convex and concave exterior along its length. Further, the handle 102 has an hourglass shape. These convex and concave surfaces 109 perform a dual purpose of allowing the user to more easily grip the toothbrush, but also mating with corresponding convex and concave surfaces 203 of the dentifrice container 200.

As shown in FIG. 2A, the dentifrice container 200 has sidewalls 203 shaped with curved contours 208 and the toothbrush handle 102 is ergonomically shaped with curved contours 109. Curved contours 208 of the dentifrice container 200 correspond to curved contours 109 of the toothbrush handle 102. Therefore, when the toothbrush handle 102 is engaged with the dentifrice container 200, the curved contours 208 and 109 mate to create a compact assembled unit. As shown in the FIG. 2A, concave and convex surfaces of both the toothbrush handle 102 and dentifrice container 200 extend along a length from the top to the bottom of each the toothbrush handle 102 and dentifrice container 200. While the embodiments shown in FIGS. 1-4 have curved surfaces, the structure is not limited to such surfaces. In fact, any surfaces, such as angular or rectangular, may be used as long as the nesting/mating feature of the toothbrush 100 to the dentifrice container 200 is realized. Accordingly, it may be complementary shaped, but need not be.

Further, the toothbrush handle 102 can act as a sidewall of the assembled unit. In this configuration, the ergonomic shape of the toothbrush handle 102 provides curved contours in the shape of the assembled unit so as to enable comfortable gripping of the assembled unit by the user.

The head 101 includes a tooth cleaning element 104. In one embodiment, the tooth cleaning element 104 is a plurality of bristles connected to the head. It is understood that the bristles are preferably made from nylon although other materials could be used. The bristles also preferably have a generally circular cross-sectional shape, but could have other cross-sectional shapes as well. The diameter of the bristles can vary depending on the desired cleaning action of the bristles. It is recognized that tooth cleaning element 104 may include elastomeric elements in addition to or in lieu of the bristles. The toothbrush 100 may, but need not, include a pliable cushioning member 108. This pliable cushioning member 108 can be used in assist in the gripping and the manipulating of the toothbrush 100.

In an illustrative embodiment shown in FIGS. 1 and 2A, the toothbrush 100 includes an engaging member 105, a top surface of the handle 106, and a bottom surface of the handle 107. The toothbrush 100 also includes an upper portion of the handle 110 and a bottom portion of the handle 111. As described below, the engaging member 105 engages with the dentifrice container 200 to secure the toothbrush 100 to the dentifrice container 200. As shown in FIG. 2, the engaging member 105 may be positioned on the bottom surface of the handle 107. The engaging member 105 can have a variety of forms. For example, the engaging member 105 may be a protrusion, slot, spring loaded button, etc. This is not an exhaustive list, but rather merely illustrative. One of ordinary skill in the art will recognize other forms of the engaging member 105 that are within the scope of this invention. In the embodiment illustrated in FIGS. 1 and 2A, the engaging member 105 is a protrusion.

Figure 3:
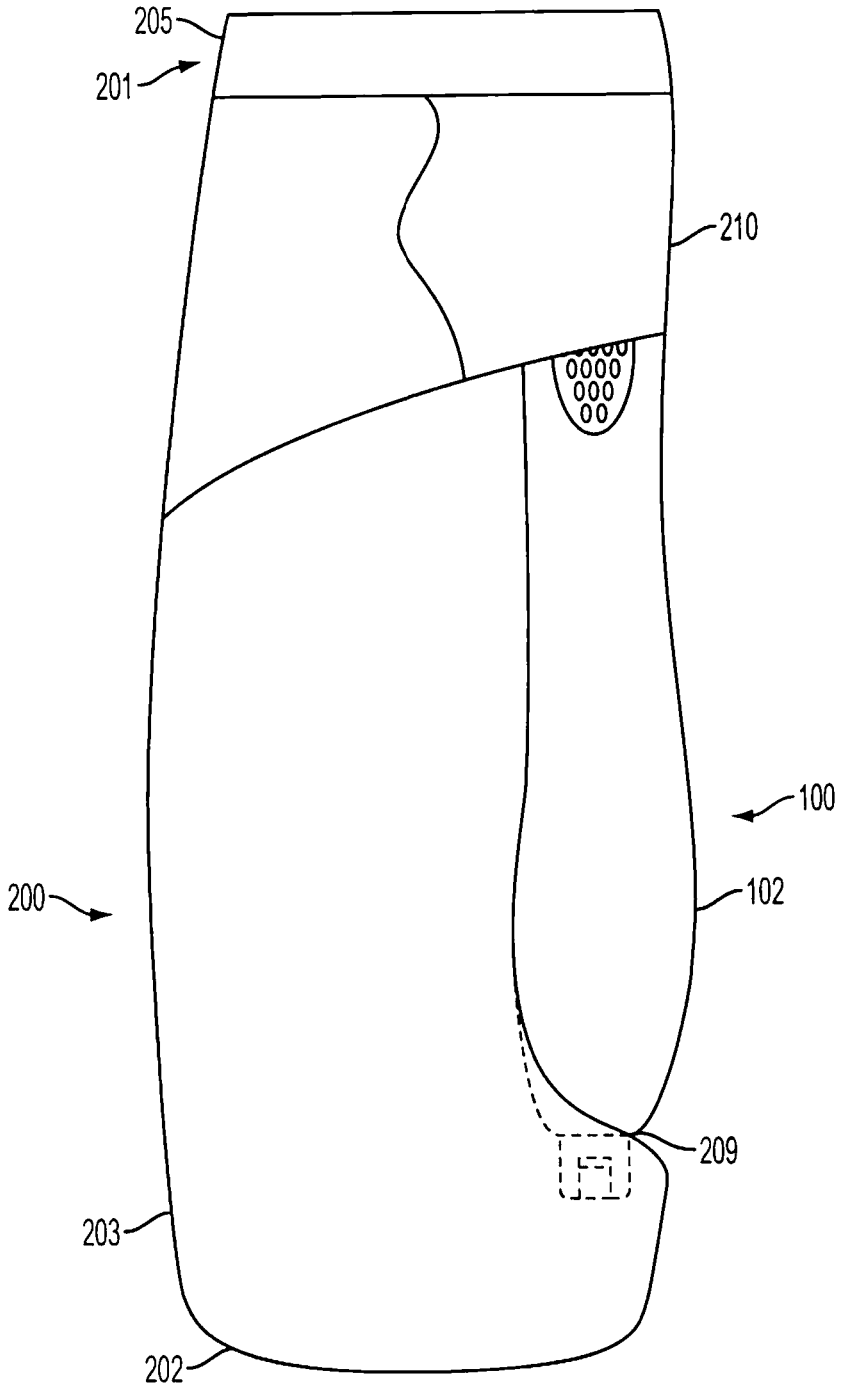
FIG. 3 is a front view of an oral care system according to one or more aspects of an alternative illustrative embodiment wherein portions of the oral care system are engaged and the oral care implement is in a transport state.
Figure 4:
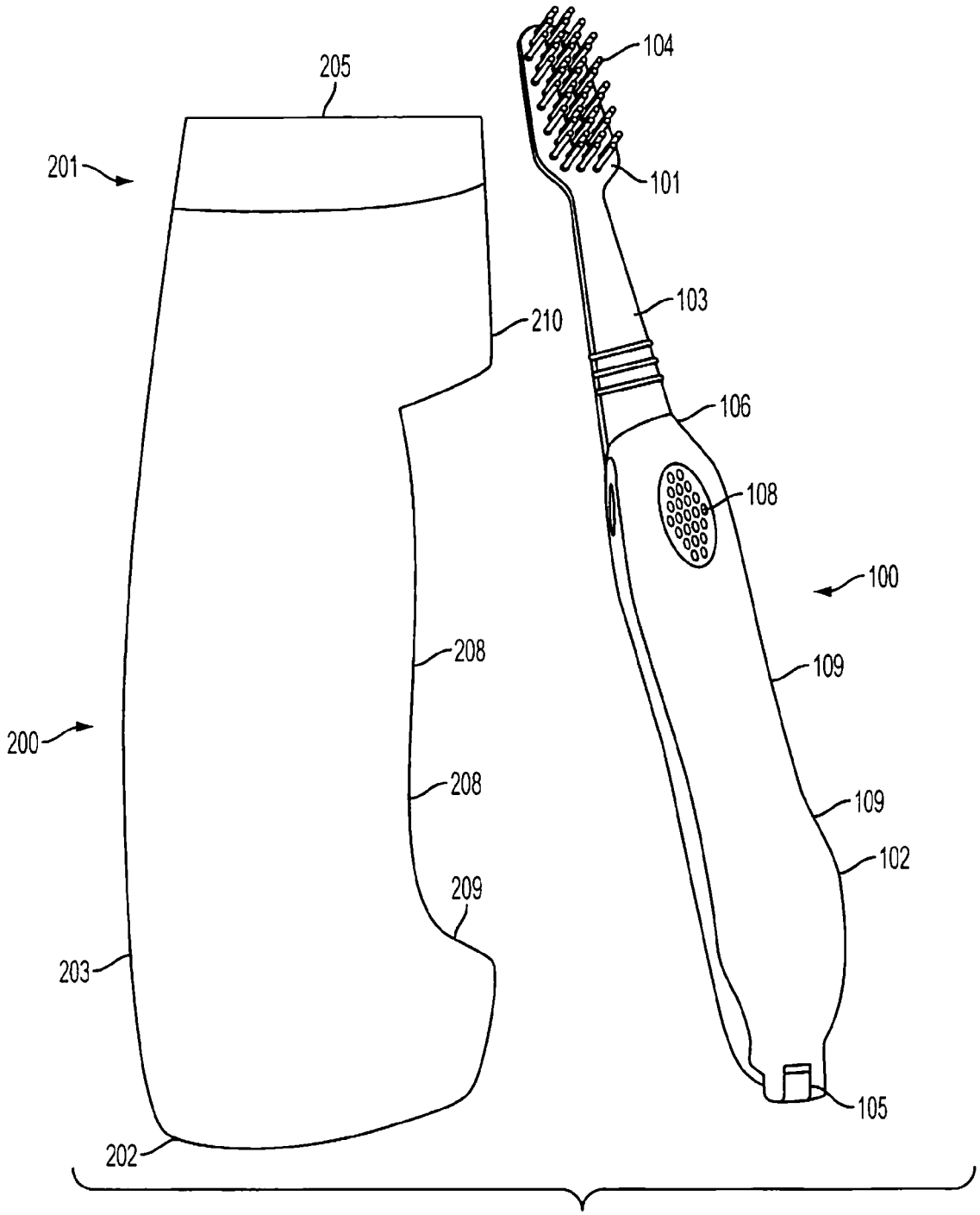
FIG. 4 is a front view of the oral care system of FIG. 3, wherein portions of the oral care system are disengaged and the oral care implement is in a use state.
Figure 5:
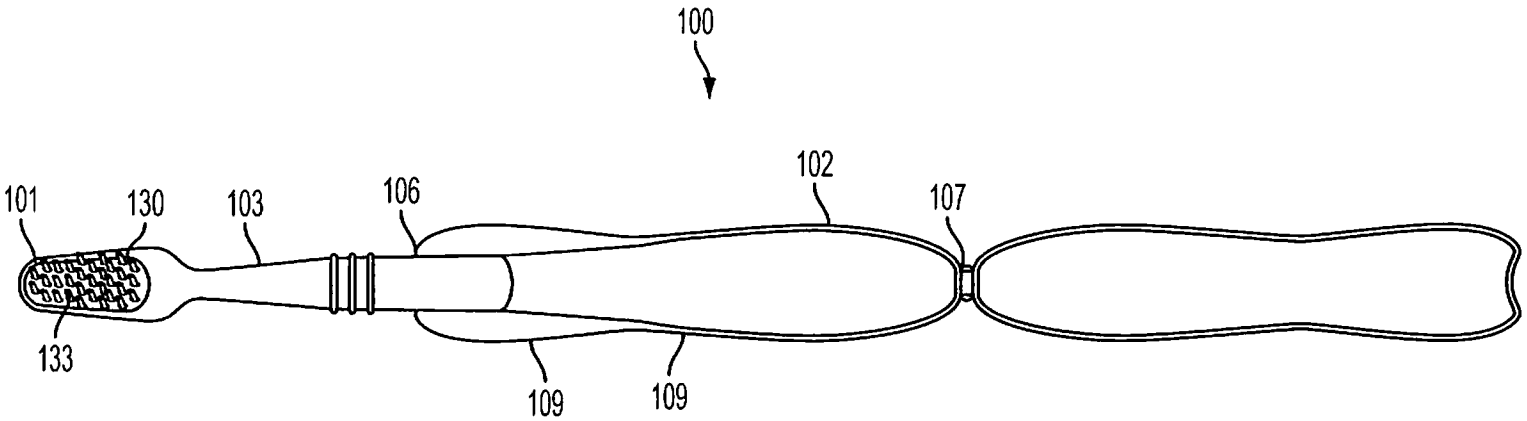
FIG. 5 is a top view of an oral care implement according to one or more aspects of an illustrative embodiment shown in an intermediary state.
Figure 6:
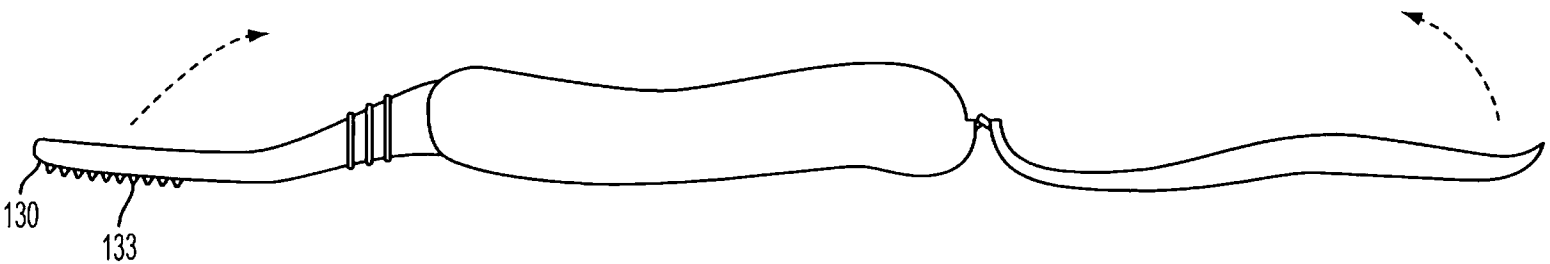
FIG. 6 is a side view of an oral care implement according to one or more aspects of an illustrative embodiment shown in an intermediary state.

As shown in illustrative embodiments FIGS. 5 and 6, the toothbrush 100 is collapsible. As indicated by the arrows in FIG. 6, the collapsible toothbrush 100 can be moved between a "use" state such as shown in FIGS. 2A and 4 and a "transport" state such as shown in FIGS. 1 and 3. In a "use" state the brush is extended so that the head 101 and neck 103 are exposed in order to allow the user to brush their teeth. In a "transport" state the entire head 101 and the neck 103 are completely enclosed within the handle 102 to prevent foreign matter from contacting any portion of the head 101 or neck 103. The enclosure of the head 101 and the neck 103 is advantageous because, when the toothbrush 100 is used, the head 101 of the toothbrush 100 and at least a portion of the neck 103 are placed in the user's mouth. As mentioned above, health complications can be caused by using a toothbrush with an unsanitary head. Therefore, this feature can keep the entire head 101 and the neck 103 sanitary when the toothbrush 100 is not being used.

In an embodiment such as shown in FIGS. 5 and 6, toothbrush 100 may additionally include a tissue cleaning element 130. As shown in FIGS. 5 and 6, the tissue cleaning element 130 may be positioned on the back of the head 101 of toothbrush 100. The tissue cleaning element 130 may be a pad composed of elastic material. The tissue cleaner may include a plurality of nubs 133 extending for cleaning between the papillae of the tongue. The nubs 133 may be conically-shaped or shaped in any desired configuration known in the art. The tissue cleaning element 130 can be used to reduce oral malodor problems or remove oral epithelial cells. However, the toothbrush 100 need not include a tissue cleaning element 130. It is recognized that the tissue cleaning element is encased in handle 102 in the "transport" state.

The oral care system also includes a dentifrice container 200. The dentifrice container 200 generally includes a top 201, a bottom 202, sidewalls 203 and a storage channel which can retain a toothbrush. As commonly known, the internal design of the dentifrice container 200 forms a compartment for holding dentifrice, such as toothpaste or gel. The dentifrice container 200 also includes a dispenser 204 for dispensing the dentifrice and a lid 205. The dentifrice container 200 also includes engaging members 206 and 207.

In the illustrative embodiment of FIG. 2A, the dispensing member 204 and the lid 205 are positioned at a top 201 of dentifrice container 200. However, this particular positioning of the dispensing member 204 and the lid 205 is not required. The lid 205 may be hinged to the dentifrice container 200. However, the lid 205 may be attached to the dentifrice container 200 in many other ways such as snap fit, tethered, etc. As shown in FIG. 1, the lid 205 is configured to cover the dispenser 204. This can prevent the dentifrice from leaking or otherwise being unintentionally dispensed from the dispenser 204. Also, as shown in FIG. 1, the lid 205 can cover a portion of the toothbrush 100 when the toothbrush 100 is engaged with dentifrice container 200. For example, as shown in FIG. 1, the lid 205 can cover a portion of the handle 102 of the toothbrush 100, such as the bottom surface of the handle 107.

In one embodiment, the opening of the lid 205 releases the toothbrush 100. For example, as seen from FIG. 2A, if the lid 205 of the dentifrice container 200 is opened, the toothbrush 100 may be removed. However, as shown in FIG. 1, when the lid 20D is closed, the toothbrush 100 is retained by the dentifrice container 200. In this way, the toothbrush 100 is retained even when the oral care system is being carried. This is also shown in FIG. 2B which discloses a top schematic view of the dentifrice container 200 and the toothbrush 100. As can be seen in FIG. 2B the toothbrush handle 102 is retained in the dentifrice container 200 by the lid 205. This method of securing the toothbrush 100 with the lid 205 of the dentifrice container 200 ensures the toothbrush 100 will not be inadvertently detached from the dentifrice container 200 during travel. This is because, such an embodiment requires the lid 205 to opened in order for the toothbrush 100 to be released. Hence, the lid 205 aids in preventing disengagement of the toothbrush handle 102 from the dentifrice container 200 by restraining the movement of the toothbrush handle 102 in, for example, a horizontal or vertical direction.

In an alternative embodiment, the lid 205 of the dentifrice container may remain closed when disengaging the toothbrush 100 from the dentifrice container 200. In this way, if the lid 205 were to remain closed, the toothbrush 100 could still be disengaged from the dentifrice container 200 by pulling the toothbrush 100 out of a friction fit with engaging member 206.

An illustrative embodiment of the compact assembled unit is shown in FIG. 1. This aspect of the invention can make the portable oral care system convenient for users. For example, it is more convenient to carry or store such an assembled unit as opposed to two or three separate pieces. In other words, the user will not have to carry a separate toothpaste dispenser, a separate toothbrush and a separate toothbrush container. This assembled unit also can prevent misplacement of one of portions of the oral care system because the portions of the oral care system are engagable. Further, the ergonomic shape of the assembled unit allows for easier gripping of the structure. The nesting or mating features of the toothbrush handle 102 with the dentifrice container 200 provides the compact structure. While the embodiment shown in FIG. 1 demonstrates curved, convex and concave surfaces, any surfaces are contemplated so long as the nesting/mating feature of the toothbrush to the dentifrice container 200 is realized. For example, other angular or rectangular surfaces are included within the scope of this feature.

One method of engagement of the toothbrush 100 with dentifrice container 200 is shown in FIG. 1. The handle 102 is engageable with the dentifrice container 200 so that the bottom surface of the handle 107 is engaged with the lid 205 of the dentifrice container, and a top surface of the handle 106 is engaged with a bottom 202 of the dentifrice container 200. Such engagement can be accomplished several ways. For example, in the illustrative embodiment shown in FIG. 2A, engaging member 206 is positioned at a top surface of the bottom 202 of the dentifrice container 200. Further, in the illustrative embodiment shown in FIG. 2A, engaging member 206 is a protrusion. This is, however, one embodiment of the engaging member 206 and should not be construed as limiting. Additionally, engaging member 206 may be molded, elastic, spring loaded, etc. As shown in FIG. 2A, another engaging member of the dentifrice container, engaging member 207, may be positioned at the lid 205 of the dentifrice container 200. The engaging member 207 could take several forms, however, in one embodiment, the engaging member is merely a vertical sidewall of the lid. This vertical sidewall of the lid may retain the toothbrush 100 by engaging toothbrush engaging member 105. Alternatively, the engaging member 207 could be a configured portion on the inside of the lid 205. In this way, the engaging member 207 would be adapted to mate with engaging member 105 of the toothbrush 100. Regardless of their form, the dentifrice container's engaging members 206 and 207 can engage the handle 102 of the toothbrush 100. FIG. 1 shows both the toothbrush's engaging member 105 engaged with dentifrice container's corresponding engaging member 207 and the dentifrice container's engaging member 206 engaged with a top surface of the handle 106.

Therefore, as can be seen from FIG. 1, the toothbrush 100 can be reliably engaged and secured to dentifrice container 200 by engaging the toothbrush engaging member 105 with dentifrice engaging member 207 and engaging the top surface of the handle 106 with dentifrice engaging member 206. Accordingly, the top surface of the handle 106 can be covered to ensure sanitary protection. This is advantageous because if the top surface of the handle 106 becomes contaminated, such contamination can be easily transferred to the neck portion 103 and head 101 of the toothbrush. As mentioned above, using a toothbrush with an unsanitary head can cause health complications. Therefore, it is desirable to have the top surface of the handle 106 covered to ensure sanitary protection. In the collapsible toothbrush described above, while the toothbrush is in the "transport" state, the head 101 and neck 103 of the toothbrush 100 is enclosed within the handle 102 of the toothbrush and therefore kept sanitary.

While a collapsible toothbrush alone provides a first level of protection for ensuring the toothbrush remains sanitary, the covering of the top surface of the handle 106 provides the portable care system with a "double" sanitary ensuring feature. Consider the contact between the top surface of the handle 106 and the neck 103 of the toothbrush 100 while the toothbrush 100 is in the "use" state or when the toothbrush 100 is converted from the "transport" state to the "use" state or vice versa. Further, consider the generally close proximity of the top surface of the handle 106 to the neck 103 and the head 101 of the toothbrush 100 while the toothbrush is in the "use" state. Even in the "transport" state, the exterior of the toothbrush, such as the top surface 106 may be contaminated.

If the top surface of the handle 106 becomes contaminated, it may transfer contamination to the head 101 and neck 103 of the toothbrush once the head 101 and neck 103 of the toothbrush 100 are exposed during opening of the toothbrush 100 to the "use" state. Therefore, as shown in FIG. 1, the dentifrice container 200 is designed to cover a top surface of the handle 106 which is near the head 101 and neck 103 of the toothbrush 100. By covering the top surface of the handle 106, the sanitary state of the head 101 is better ensured. Therefore, the above described feature provides a "double" sanitary ensuring feature. Initially, the toothbrush 100 can be converted to a "transport" state. This ensures the head 101 and neck 103 are kept sanitary. Secondly, the dentifrice container 200 can keep the top surface of the handle 106 covered. This prevents contamination of such surfaces even while stored in a purse, gym bag, desk, locker, etc. Therefore, there will be no contamination by transference from top surface of the handle 106 to the neck 103 or head 101.

In an alternative embodiment of the oral care system, the dentifrice container 200 may include a protective member 210. As shown in FIG. 3, the protective member 210 encloses the upper portion of the handle 110. In the embodiment shown in FIGS. 3 and 4, the protective member 210 may be an awning-type of device which surrounds and encloses the handle 102. In this way, the protective member 210 can serve at least two purposes. First, the protective member 210 prevents foreign matter from contacting the upper portion of the handle 110. This can be advantageous because, as described above, even when the toothbrush is in the "transport" state, foreign matter can come into contact with the handle 102. This foreign matter has the potential to be transferred to the neck portion 103 and head 101 of the toothbrush 100.

In the collapsible toothbrush 100 described above, when the toothbrush 100 is converted from the "transport" state to the "use" state to expose the head 101 and neck portion 103, the neck portion 103 contacts the upper portion of the handle 110. This contact between the upper portion of the handle 110 and the neck portion 103 and the generally close proximity of the upper portion of the handle 110 with both the next portion 103 and the head 101 can make transfer of foreign matter from the upper portion of the handle 110 to the neck portion 103 and the head 101 likely. Therefore, preventing foreign matter from initially accumulating on the upper portion of the handle 110 would substantially diminish the likelihood of such contamination of the head 101 and the neck portion 103. Hence, the protective member 210 would substantially prevent such contamination. This covering of the upper portion of the handle 110 provides the portable care system with a "double" sanitary ensuring feature. Initially, the toothbrush 100 can be converted to a "transport" state. This ensures the head 101 and neck 103 are kept sanitary. Secondly, the dentifrice container 200 can keep the top the upper portion of the handle 110 covered. This prevents contamination of such surfaces even while stored in a purse, gym bag, desk, locker, etc. Therefore, there will be no contamination by transference from the upper portion of the handle 110 to the neck 103 or head 101.

A second purpose of the protective member 210 is to aid in retaining the toothbrush 100 in engagement with the dentifrice container 200. By enclosing the upper portion of the handle 110, the protective member 210 assists in retaining the toothbrush 100 in engagement with the dentifrice container 200. The protective member 210 aids in preventing disengagement of the toothbrush handle 102 from the dentifrice container 200 by restraining the movement of the toothbrush handle 102 in, for example, a horizontal or vertical direction.

In this alternative embodiment, the dentifrice container may include an engaging interface 209. In the embodiment illustrated in FIG. 3, the engaging interface 209 is a recess. However, a recess is not required and the engaging interface may take many other forms. As shown in FIG. 3, the engaging interface 209 is positioned at a bottom portion of the dentifrice container 200. The engaging member 105 of the toothbrush 100 can engage with the engaging interface 209 to secure the toothbrush 100 to the dentifrice container 200.

As with the previous embodiment, in this illustrative alternative embodiment, the dentifrice container 200 has curved contours 208 which correspond to the curved contours 109 of the ergonomic toothbrush 100. Therefore, when the toothbrush 100 is engaged with the dentifrice container 200, the curved contours 208 and 109 mate to create a compact assembled unit. Further, the toothbrush 100 can act as a sidewall of the compact assembled unit. In this configuration, the ergonomic shape of the toothbrush provides curved contours in the shape of the assembled unit so as to enable comfortable gripping of the assembled unit by the user. As shown in the FIG. 4, concave and convex surfaces of both the toothbrush handle 102 and dentifrice container 200 proceed along a length from the top to the bottom of each the toothbrush handle 102 and dentifrice container 200. While the embodiments shown in FIGS. 3 and 4 have curved surfaces, the structure is not limited to such surfaces. In fact, any surfaces, such as angular or rectangular, may be used.

As shown in FIG. 3, the compact assembled unit can make the portable oral care system convenient for users. For example, it is more convenient to carry or store such an assembled unit as opposed to two or three separate pieces. In other words, the user will not have to carry a separate toothpaste dispenser, a separate toothbrush and a separate toothbrush container. This assembled unit also can prevent misplacement of one of portions of the oral care system because the portions of the oral care system are engagable. Further, the ergonomic shape of the assembled unit allows for easier gripping of the structure.

The compact nature of this portable oral care system is advantageous over the carrying separate items such as a toothbrush, toothpaste dispenser, container for enclosing the toothbrush, etc. Therefore, this compactness allows the portable oral care system to be kept in many places such as a purse, gym bag, desk, locker, etc.

Further, the oral care system's retaining features prevent the toothbrush handle 102 from be inadvertently disengaged from the dentifrice container 200. This allows the portable oral care system to be kept in many places such as a purse, gym bag, desk, locker, etc. without concern of misplacing or losing a portion of the oral care system.

Further, the portable care system has a "double" sanitary ensuring feature. This "double" sanitary ensuring feature is provided by both the collapsible toothbrush 100 and the dentifrice container 200. Initially, the toothbrush 100 can be converted to a "transport" state. This ensures the head 101 and neck 103 are kept sanitary. Secondly, the dentifrice container 200 can keep the top surface of the handle 106 and the upper portion of the handle 110 covered. This prevents contamination of such surfaces even while stored in a purse, gym bag, desk, locker, etc. Therefore, there will be no contamination by transference from either the upper portion of the handle 110 or top surface of the handle 106 to the neck 103 or head 101. This feature allows the user to store the portable oral care system in a purse, gym bag, desk, locker, etc. with greater confidence that the toothbrush will not be contaminated.

Figure 7A:
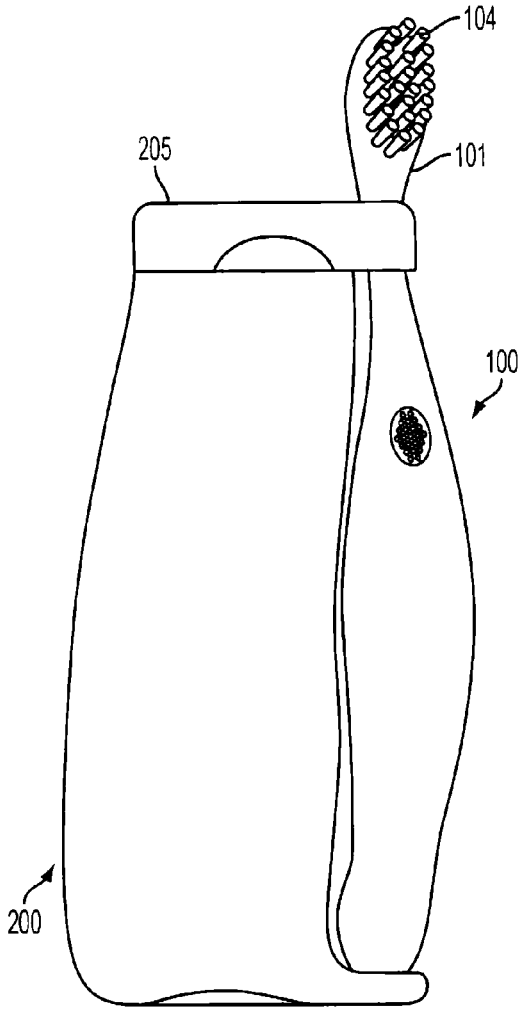
FIG. 7*a* is a front view of an oral care system according to one or more aspects of an alternative illustrative embodiment wherein portions of the oral care system are engaged.
Figure 7B:
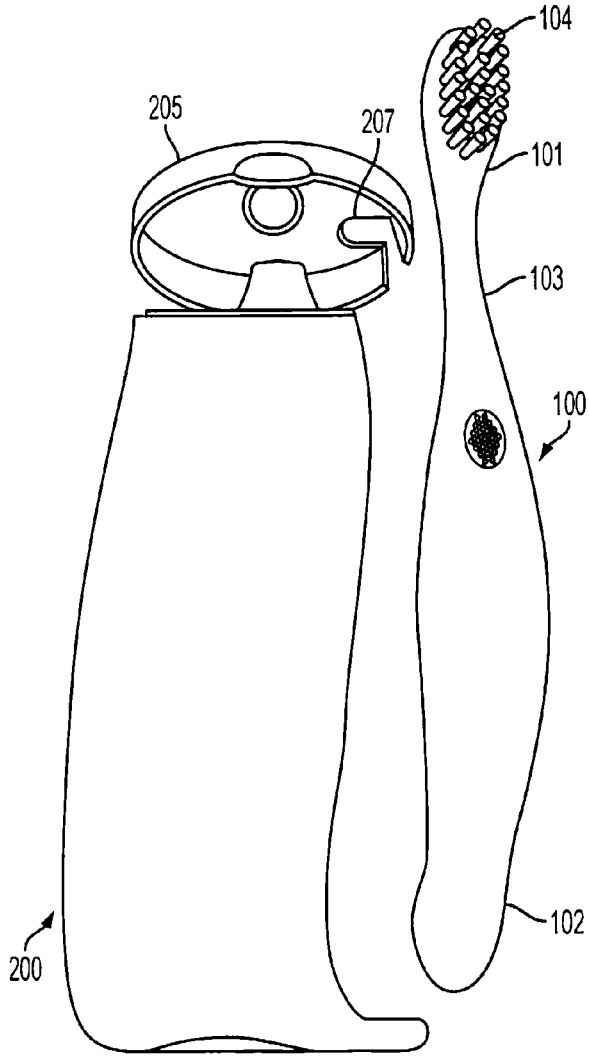
FIG. 7*b* is a front view of the oral care system of FIG. 7*a*, wherein portions of the oral care system are disengaged.

An alternative embodiment of the invention is shown in FIG. 7*a*. In this illustrative embodiment the toothbrush 100 engages with the lid 205 the dentifrice container 200. The lid 205 has an engaging member 207. In the illustrated embodiment the engaging member 207 includes the edges of an aperture through the top of the lid 205. The engaging member 207 may also be configured so that a vertical sidewall of the lid removed as shown in FIG. 7*b*, but this is not required. The removal of the vertical side wall allows easier insertion and removal of the toothbrush 100 from the dentifrice container 200. In this illustrated embodiment, the head 102 of the toothbrush extends through the aperture in the lid 205 of the dentifrice container 200 and the neck 103 of the toothbrush 100 is held by the engaging member 207.

This embodiment has the ability to prevent the lid 205 from opening inadvertently. For example, as seen in FIG. 7*a* while the toothbrush 100 is engaged with the lid 205 of the dentifrice container, the lid 205 cannot be pivoted to be opened because the toothbrush neck 103 will prevent the pivotable movement of the 205.

In this embodiment, the toothbrush 100 may be held in the dentifrice container 200 solely by the engaging member 207 or may include other engaging members either on the toothbrush 100 or the dentifrice container 200. For example, another engaging member may be positioned at the bottom of the handle 102 and yet another engaging member may be positioned at the top surface of the bottom of the dentifrice container 200. These two additional engagement members may be operable with each other to secure the toothbrush to the dentifrice container along with the engaging member 207.

While the invention has been described with respect to specific examples including presently preferred modes of carrying out the invention, those skilled in the art will appreciate that there are numerous variations and permutations of the above described systems and techniques. Thus, the spirit and scope of the invention should be construed broadly as set forth in the appended claims.

I claim:

1. A portable oral care system comprising:

an oral care implement including, a handle, a neck portion and a head having a tooth cleaning element, wherein the oral care implement is collapsible to be configurable between a use state and a transport state in which the neck portion and the head are positioned within the handle;

a dentifrice container including a cavity for holding dentifrice, and a dispensing outlet;

wherein when the oral care implement is in the transport state:

the handle is engagable with the dentifrice container for securing the oral care implement to the dentifrice container, and the dentifrice container contacts a bottom surface of the handle, a top surface of the handle, and a side surface of the handle between said top surface and said bottom surface, wherein the dentifrice container has a pair of opposing sidewalls, and wherein the side surface of the handle and a sidewall of the pair of opposing sidewalls are shaped complementary to each other to enable the oral care implement and the dentifrice container to engage and nest, and wherein the oral care implement includes an engaging member at the bottom of the handle and the dentifrice container includes a corresponding engaging member on a lid of the dentifrice container, further wherein the handle is engagable with the dentifrice container so that the bottom of the handle is engagable with the lid of the dentifrice container and a top surface of the handle is engagable with a bottom of the dentifrice container.

2. The system of claim 1, wherein the side surface of the handle is generally hourglass shaped.

3. The system of claim 1, wherein the lid includes a sidewall around a perimeter of the lid which can retain the engaging member of the oral care implement.

4. The system of claim 1, wherein the dentifrice container includes a second engaging member positioned at a top surface of the bottom of the dentifrice container and is configured to engage with the top surface of the handle and further wherein the dentifrice container and the second engaging member of the dentifrice container are configured to cover the top surface of the handle.

5. The system of claim 1, wherein the dentifrice container includes a storage channel and a protective member, wherein when the oral care implement is placed into to the storage channel, the protective member is configured to surround and enclose the oral care implement so as to prevent foreign matter from contacting an upper handle portion of the oral care implement.

6. The system of claim 5, wherein when the oral care implement is placed into the storage channel, the dentifrice container is configured to engage the oral care implement along a bottom surface of the handle, a top surface of the handle and a side surface of the handle between said top surface and said bottom surface, so that the handle is nested with the dentifrice container.

7. The system of claim 6, wherein the side surface of the handle is generally hourglass shaped and the dentifrice container has a pair of opposing sidewalls, and wherein the side surface of the handle and a sidewall of the pair of opposing sidewalk are shaped complementary to each other to enable the oral care implement and the dentifrice container to engage and nest, when the oral care implement is engaged with the dentifrice container.

8. The system of claim 7, wherein the oral care implement includes an engaging member provided at the bottom of the handle which is configured to engage a corresponding engaging member of the dentifrice container positioned at a lower portion of the dentifrice container, when the oral care implement is placed in the storage channel.

* * * * *